US011447212B2

(12) United States Patent
Jacobson

(10) Patent No.: US 11,447,212 B2
(45) Date of Patent: Sep. 20, 2022

(54) STABILIZED FLOTATION PLATFORM

(71) Applicant: Rhonda Jacobson, Mesick, MI (US)

(72) Inventor: Rhonda Jacobson, Mesick, MI (US)

( * ) Notice: Subject to any disclaimer, the term of this patent is extended or adjusted under 35 U.S.C. 154(b) by 58 days.

(21) Appl. No.: 17/108,160

(22) Filed: Dec. 1, 2020

(65) Prior Publication Data

US 2022/0169343 A1 Jun. 2, 2022

(51) Int. Cl.

| | |
|---|---|
| ***B63B 34/00*** | (2020.01) |
| ***B63B 21/20*** | (2006.01) |
| ***B63B 45/00*** | (2006.01) |
| ***B63B 5/24*** | (2006.01) |
| ***B63B 3/14*** | (2006.01) |
| ***B63B 29/04*** | (2006.01) |

(52) U.S. Cl.

CPC ..... *B63B 34/00* (2020.02); *B63B 3/14* (2013.01); *B63B 5/24* (2013.01); *B63B 21/20* (2013.01); *B63B 29/04* (2013.01); *B63B 45/00* (2013.01)

(58) Field of Classification Search

CPC .. B63B 34/00; B63B 3/14; B63B 5/24; B63B 21/20; B63B 29/04; B63B 49/00

See application file for complete search history.

(56) References Cited

U.S. PATENT DOCUMENTS

| | | | | |
|---|---|---|---|---|
| 23 | A * | 9/1836 | Fickardt | F24H 3/065 126/117 |
| 5,162,007 | A * | 11/1992 | Leslie | A47C 27/081 441/136 |
| 5,518,431 | A * | 5/1996 | Staley | A47C 15/006 441/130 |
| 6,014,833 | A * | 1/2000 | Benavidez | A01K 97/06 206/315.11 |
| 6,139,382 | A * | 10/2000 | Eschbacher | B63B 22/24 441/32 |
| 6,171,160 | B1 | 1/2001 | Skaggs et al. | |
| 6,976,434 | B2 | 12/2005 | Roig et al. | |
| 7,300,104 | B1 * | 11/2007 | Hagedorn | A47B 37/04 297/158.3 |
| 7,344,138 | B2 | 3/2008 | Romney | |
| D592,268 | S | 5/2009 | Montagnino | |
| 7,850,534 | B2 * | 12/2010 | Smith | A63D 15/00 473/4 |
| D663,364 | S | 7/2012 | Allmandinger | |
| D740,373 | S | 10/2015 | Martin | |
| 2014/0110413 | A1 * | 4/2014 | Kelly | B63B 22/24 220/560 |
| 2016/0325197 | A1 * | 11/2016 | Smith | B60N 3/103 |
| 2019/0100286 | A1 * | 4/2019 | Kennedy | E04H 4/14 |

* cited by examiner

*Primary Examiner* — S. Joseph Morano
*Assistant Examiner* — Jovon E Hayes

(57) ABSTRACT

A stabilized flotation platform that is used for supporting supplies for those enjoying time in the water. The uniqueness is the stability provided by its construction such that materials contained on or in the device do not spill into the water.

10 Claims, 6 Drawing Sheets

STABILIZED FLOTATION PLATFORM

BACKGROUND OF THE INVENTION

The instant invention deals with a stabilized flotation platform that is used for supporting supplies for those enjoying the water. The uniqueness of the instant invention is the stability provided by its construction such that materials contained on or in the device do not spill into the water.

There are many devices manufactured from foam that are used in and around water. For example, there is the well-known noodle that is an elongated, usually round in construction foam object, that is used by children for floating in water.

Knee boards, tables, surfing boards and even water skis are also manufactured from foam.

In U.S. Pat. No. 6,171,160 that issued Jan. 9, 2001, to Skaggs, et al there is shown a floating device which is a table that has unitary structure and is useful in water or on land, having a weighted base and a water-draining top surface. The weighted base is required to stabilize the device.

U.S. Pat. No. 6,976,434 that issued Dec. 20, 2005, to Roig, et al deals with a floating amphibious game table. The game table floats but is stabilized by legs and can be used on water or on land.

U.S. Pat. No. 7,344,138 that issued on Mar. 18, 2008, to Romney deals with a floating poker pad that is used on land and on water. It is not described how the pad is stabilized in water. Apparently, the pad is large and is hollow, both of which lead to its stability in water.

U.S. D592,2685 that issued on May 12, 2009, to Montagnino deals with an ornamental design for a floating picnic table.

U.S. D663,3645 that issued on Jul. 10, 2012, to Allmandinger deals with a floating table. There is no detail on stability of the device in water. The same situation abides with the design shown in U.S. D740,373 that issued Oct. 6, 2016, to Martin.

THE INVENTION

Thus, there is disclosed and claimed herein a stabilized floating platform. The platform comprises a center platform manufactured from rigid foam and having an outside wall and a semi-rigid foam ring attached-to and encircling the outside wall. The semi-rigid foam has a buoyancy greater than the center platform foam and the center platform has a plurality of through holes for holding liquid containers. There is a large opening in the center platform foam for holding a large container.

DETAILED DESCRIPTION OF THE INVENTION

Figure 1:
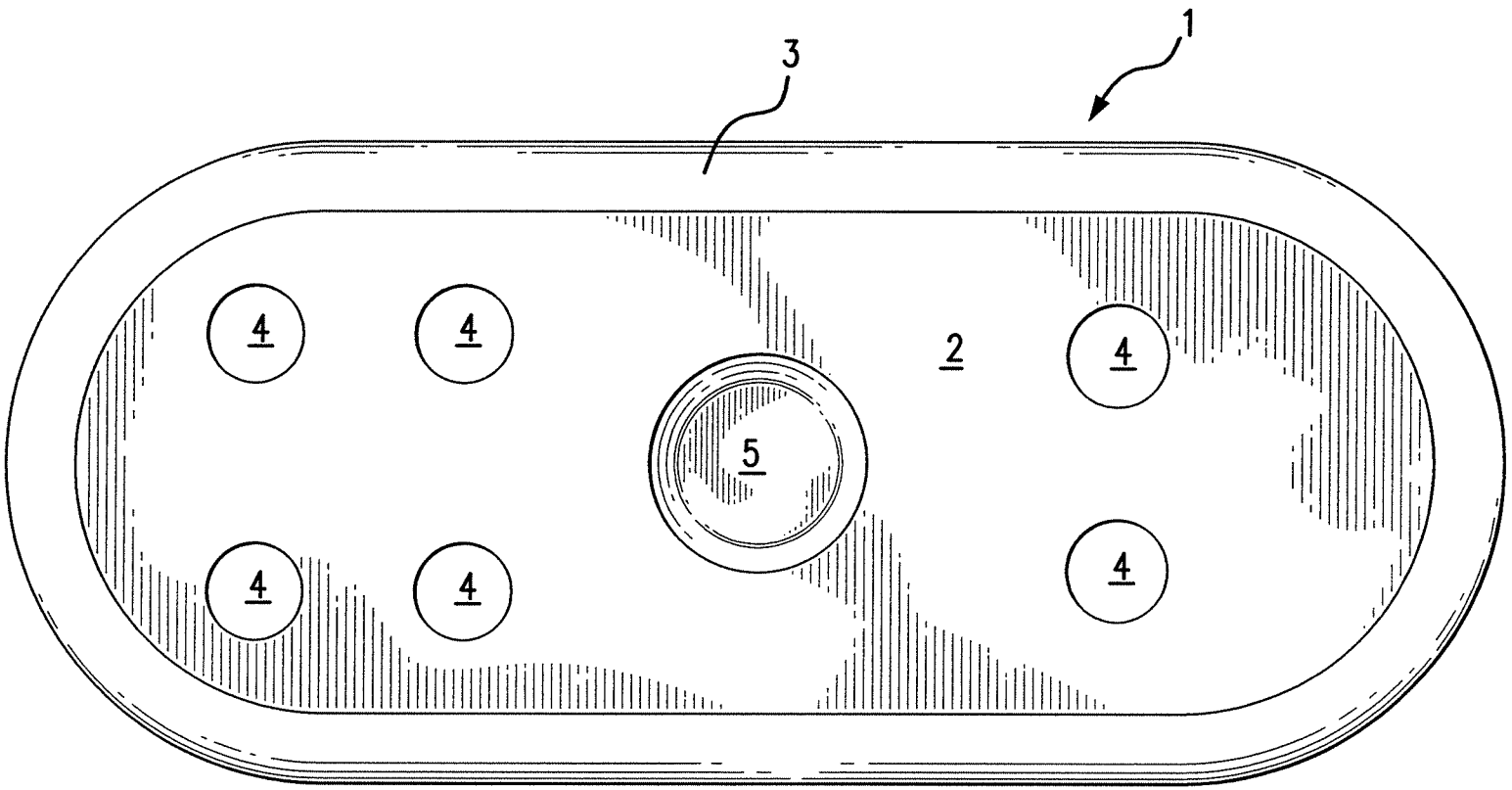
FIG. 1 is a full top view of the device of this invention showing the various openings.

FIG. 1 shows a full top view of a stabilized floating platform 1 of this invention showing a center rigid foam platform 2, and an attached semi-rigid and flexible foam ring 3 encircling the center rigid foam platform 2. The semi-rigid foam ring 3 has a buoyancy higher than the buoyancy of the center rigid foam platform 2. The device 1 of this invention is stabilized in water, meaning for purposes of this invention, that because of this differentiation in the two foams, the semi-rigid foam ring has a greater resistance to tipping over in water and stabilizes the entire device 1.

Figure 2:
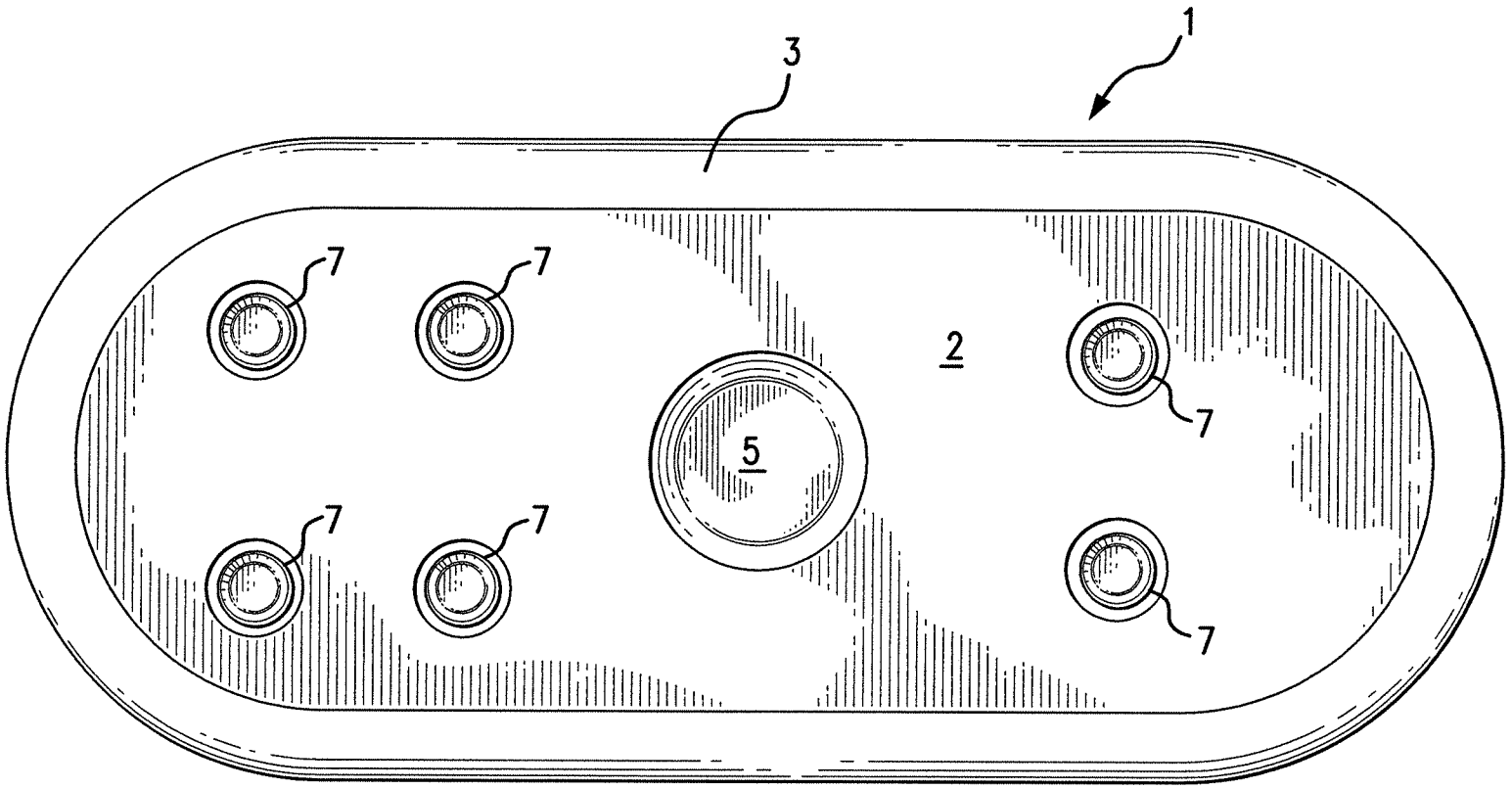
FIG. 2 is a full top view of the device of this invention showing the through holes filled with drink containers.

The center foam platform 2 has a plurality of holes 4 through it which serve as liquid container holders 7. FIG. 2 is a full top view of the stabilized floating platform with cups 7 in the openings 4. In addition, the center foam platform 2 has a large center opening 5 to hold large containers 8. By "large", for purposes of this invention, it is meant that this opening 5 is 6 to 14 inches in diameter and will hold an ice bucket or the like (See FIG. 4). Also, this opening 5 can hold containers of beverages, such as iced tea or the like. The through openings 4 have a diameter ranging from about 2 inches to about 5 inches.

Figure 3A:
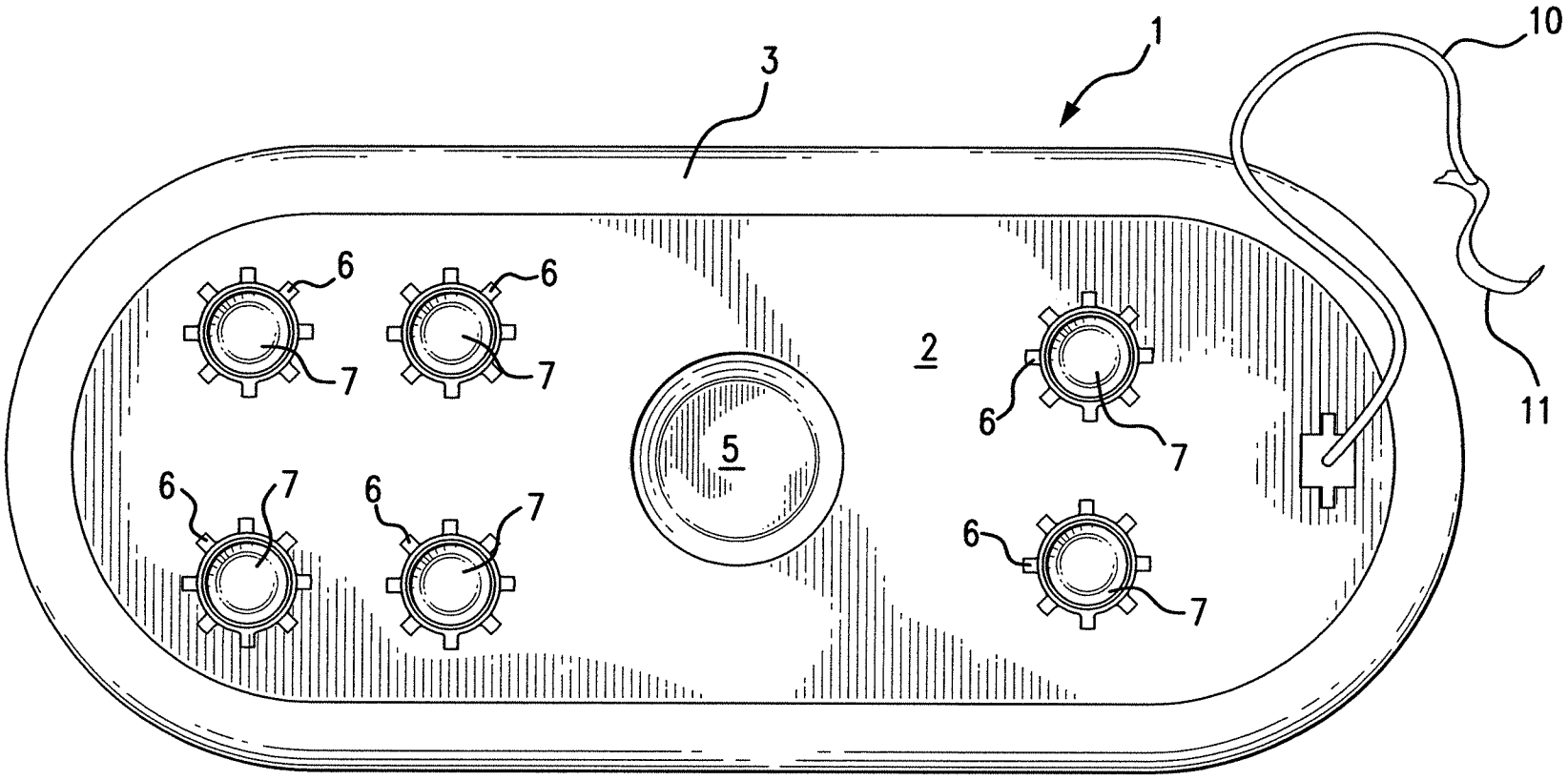
FIG. 3A is a full top view of a device of this invention showing the tumbler rings and tether.
Figure 3C:
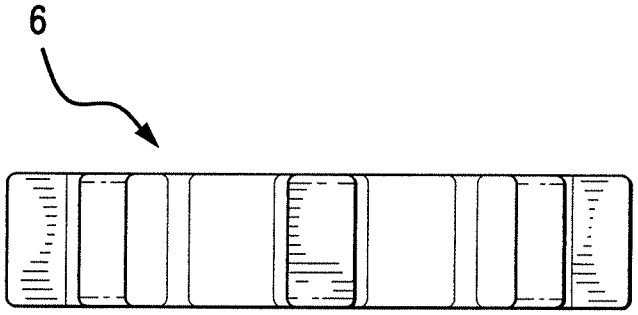
FIG. 3C is a full side view of a tumbler ring of this invention.
Figure 3B:
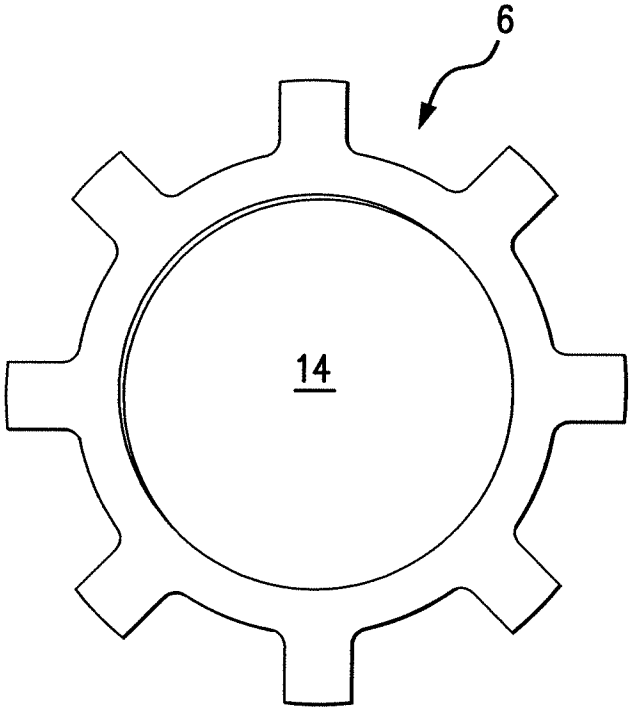
FIG. 3B is a full top view of a tumbler ring of this invention.

Some beverage containers are larger than the normal glass beverage containers and therefore, the openings 4 can have an auxiliary supporting member called a tumbler ring 6 as shown on FIGS. 3A, 3B, and 3C. FIG. 3B shows the opening 14 in the center of the tumbler ring. Surrounding the beverage container, and being larger in diameter than the beverage container, the tumbler ring 6 stabilizes the beverage container from tipping over.

Figure 4:
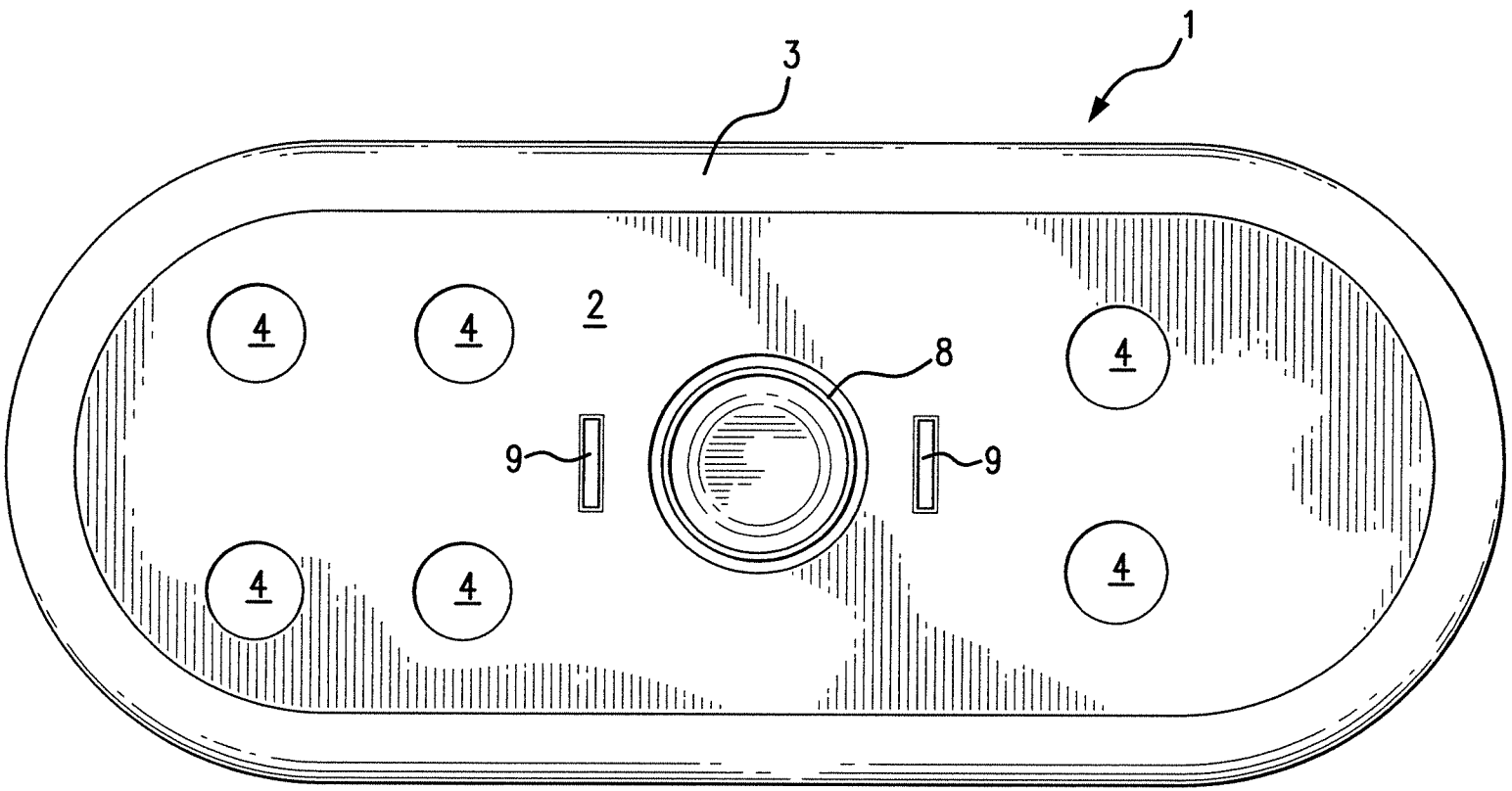
FIG. 4 is full top view of a device of this invention showing a large container in the large opening and auxiliary configurations in the center platform foam.

FIG. 4 also shows auxiliary component formations (slots or indentions) 9 for holding, for example, telephones, or other electronic devices, or other auxiliary components such as sun cream containers.

The stabilized floating platform 1 can also have a tether 10 attached to it to allow a person to maintain the platform 1 in a nearby vicinity. One means of attaching the tether to the person is an arm or leg band 11 which can close using Velcro® or something similar.

Figure 5:
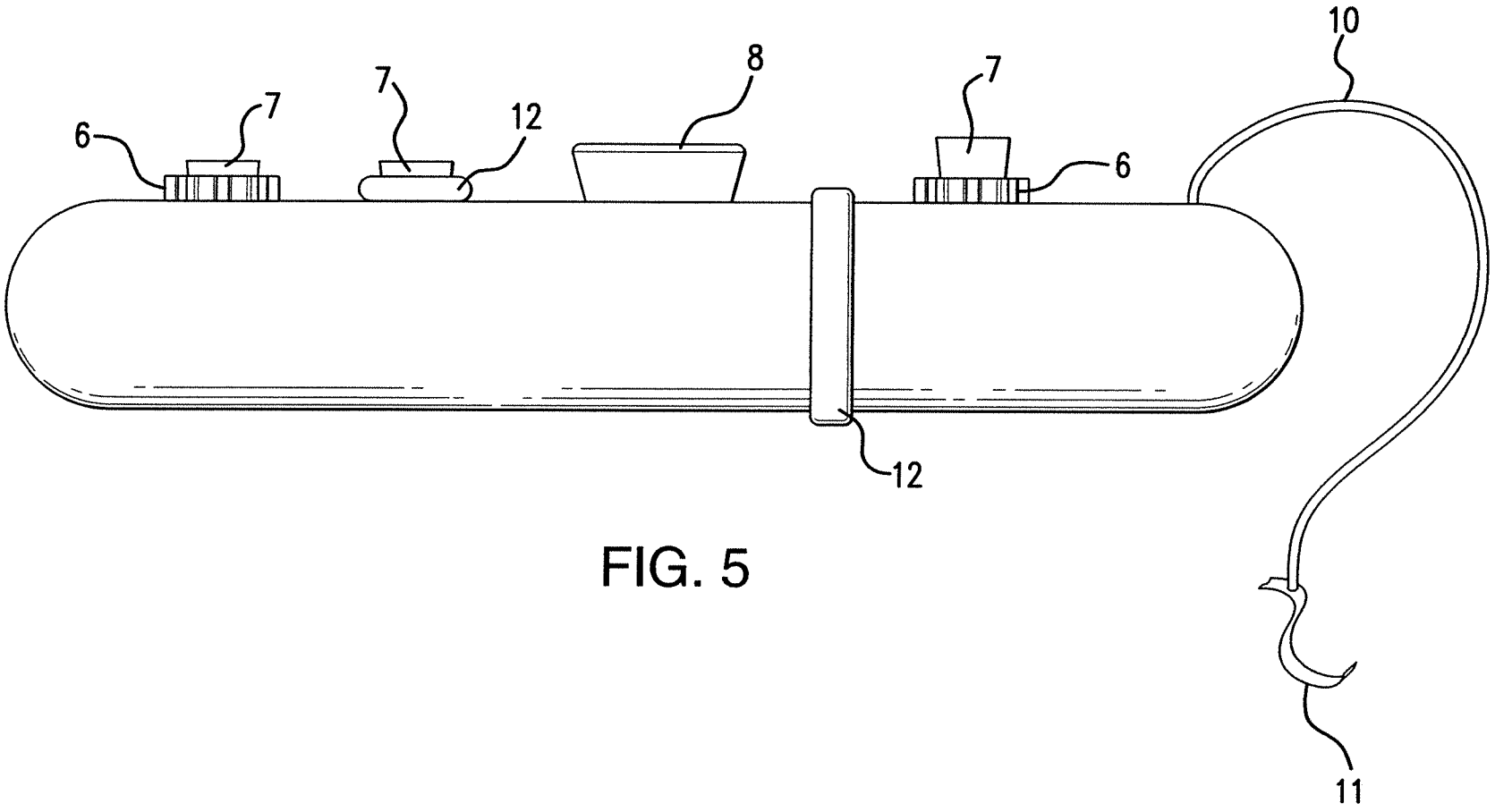
FIG. 5 is a full side view of a device of this invention.

FIG. 5 is a full side view of the platform 1 of this invention showing the semi-rigid foam ring 3, liquid containers 7, an ice bucket 8, tumbler rings 6, a tether 10, with arm band 11, and light reflectors 12 (See FIG. 5).

The stabilized floating platform 1 has a nominal size ranging from about 2 feet to 6 feet long, about 14 to 28 inches wide with the encircling semi-rigid foam ring 3 having a diameter ranging from about 3 inches to about 8 inches. The center platform 2 rigid foam thickness ranges from about 2 inches to about 6 inches.

The center platform 2 is manufactured from rigid foam. The term "rigid" is well-known to those skilled in the art, especially polyurethane foam art. Typically, this platform is manufactured from rigid polyurethane foam.

The encirculating foam ring is manufactured from semi-rigid foam and the term "semi-rigid" is well-known to those skilled in the art. This foam may be polyurethane, or vinyl or the like. It is flexible and resilient to the touch.

All foams float on water, and for this inventive device, one just has to be sure that the buoyancy of the ring 3 is higher than the buoyancy of the center platform 2 to ensure stability of the device in water.

What is claimed is:

1. A stabilized floating platform, said platform comprising:

I. a center platform manufactured from an inflatable material and having an outside wall;

II. an inflatable material ring attached to, and encircling said outside wall, said inflatable material ring having a buoyancy greater than said center platform inflatable material;

III. said center platform having a plurality of through holes for holding drink containers;

IV. a large through opening in said center flatform for holding a large container.

2. A stabilized floating platform as claimed in claim 1 wherein there is a tether attached to said stabilized floating platform.

3. A stabilized floating platform as claimed in claim 1 wherein each said plurality of through holes has a tumbler ring associated with it.

4. A stabilized floating platform as claimed in claim 3 wherein the tumbler rings are manufactured from foamed plastic.

5. A stabilized floating platform as claimed in claim 1 wherein there are container insulators inserted into each through hole in said center platform.

6. A stabilized floating platform as claimed in claim 5 wherein the container insulators are manufactured from foamed plastic.

7. A stabilized floating platform as claimed in claim 1 wherein at least one light reflector is attached to said stabilized floating platform.

8. A stabilized floating platform as claimed in claim 1 wherein the stabilized floating platform is manufactured from white inflatable material.

9. A stabilized floating platform as claimed in claim 1 wherein the stabilized floating platform is manufactured from colored inflatable material.

10. A stabilized floating platform as claimed in claim 1 wherein the stabilized floating platform has formations therein to accommodate hand-held electronic devices.

* * * * *